United States Patent [19]

Isoda

[11] Patent Number: 5,000,603

[45] Date of Patent: Mar. 19, 1991

[54] REMOVABLE CAP OF WRITING INSTRUMENT

[75] Inventor: Takashi Isoda, Yokohama, Japan

[73] Assignee: Mitsubishi Pencil Co., Ltd., Tokyo, Japan

[21] Appl. No.: 450,943

[22] Filed: Dec. 15, 1989

[51] Int. Cl.[5] ..... B43K 5/00; B43K 9/00

[52] U.S. Cl. ..... 401/202; 401/213; 401/243

[58] Field of Search ..... 401/202, 213, 243; D19/57

[56] References Cited

U.S. PATENT DOCUMENTS

| | | | |
|---|---|---|---|
| 4,844,642 | 7/1989 | Inaba et al. | 401/202 X |
| 4,915,529 | 4/1990 | List | 401/202 |

FOREIGN PATENT DOCUMENTS

| | | | |
|---|---|---|---|
| 0330877 | 9/1989 | European Pat. Off. | 401/213 |
| 6111016 | 6/1983 | Japan | 401/213 |
| 2174374 | 11/1986 | United Kingdom | 401/243 |

*Primary Examiner*—Richard J. Apley
*Assistant Examiner*—David F. Crosby
*Attorney, Agent, or Firm*—Armstrong, Nikaido, Marmelstein, Kubovcik & Murray

[57] ABSTRACT

A removable cap attached to a writing instrument in an insertion manner for preventing ink from evaporating from the writing instrument, comprises: a hollow cylindrical cap main body; and a hollow cylindrical inner cap fixedly mounted in the cap main body. The cap having been detached from the writing instrument permits open air to axially flow through the interior space of the cap through: a front axial opening of the cap; a ventilating hole of the inner cap; a space defined between the inner cap and the cap main body; and a clearance defined between a rear-end opening of the cap main body and a rear-end projecting portion of the inner cap, which projecting portion is disposed in the rear-end opening of the cap main body while space apart therefrom, whereby there is no fear that the cap suffocates infant's bronchi even if the infant swallows the cap whole.

1 Claim, 3 Drawing Sheets

REMOVABLE CAP OF WRITING INSTRUMENT

BACKGROUND OF THE INVENTION

,2 1. Field of the Invention

The present invention relates to an improvement of a removable cap attached, in an insertion manner, to a front-end portion of a writing instrument such as marking pens, markers, water-color ink ball point pens and the like so as to protect and ink-applying portion of the writing instrument from damage and also so as to prevent ink from evaporating from the writing instrument.

2. Description of the Prior Art

In general, removable caps attached to the writing instruments such as marking pens, markers and the like are made of resin material which is excellent in properties preventing ink from evaporating from the writing instruments. A conventional type of the removable caps of the writing instruments has a construction as shown in FIGS. 6 to 9, in which: a conventional removable cap 24 has a double-walled construction closed at its rear end and opened at its front end so as to provide and inner cap portion 25 in an inner space 26 of the cap 24. When the cap 24 is attached to a front-end portion of a writing instrument, the inner space 26 of the cap 24 is hermetically sealed. Consequently, the conventional removable cap of the writing instrument having the above construction is excellent in properties of preventing ink from evaporating from the writing instruments and in properties of protecting the ink-applying portion of the writing instrument from damage, and therefore, there is no problem in writing use itself. However, since the conventional removable cap 24 having the above construction is completely closed at its rear end, there is a fear that the cap 24 suffocates infant's bronchi when the infant swallows the cap 24 whole. Thus, it is apparent that the need exists for an improved removable cap which will prevent ink from evaporating from a writing instrument and protect an ink-applying portion of the writing instrument from damage without a fear that the cap suffocates infant's bronchi even if the infant swallows the cap whole.

SUMMARY OF THE INVENTION

It is an object of the present invention to provide an improved removable cap attached to a writing instrument in an insertion manner, which cap can prevent ink from evaporating from the writing instrument as is in the case of the conventional cap and is provided with an axial ventilating means for ventilating an inner space of the cap itself, the means being able to prevent an infant from being choked by the cap when the infant swallows the cap whole.

The above object of the present invention is accomplished by providing:

A removable cap attached to a writing instrument in an insertion manner for preventing ink from evaporating from the writing instrument and for protecting an ink-applying portion of the writing instrument from damage, comprising:

a hollow cylindrical cap main body having its opposite axial ends opened, the cap main body being provided with a hollow portion in its intermediate portion and an inner flange at a rear axial end, the inner flange extending radially inwardly at said rear axial end of the cap main body; and an hollow cylindrical inner cap fixedly mounted in the cap main body, the inner cap being closed at its rear end while provided with: a sleeve-like body portion an outer diameter of which is smaller than an inner diameter of the hollow portion of the cap main body and shorter in axial length than the cap main body: an outer flange portion radially extending outwardly from a front end of the sleeve-like body portion of the inner cap to serve as a means for fixing the inner cap to an inner wall of the cap main body; a plurality of ribs provided in an outer peripheral surface of an intermediate portion of the sleeve-like body portion of the inner cap, the ribs extending in an axial direction of the inner cap and being spaced apart from each other in a circumferential direction of said inner cap; a cylindrical projecting portion provided at a rear end of the inner cap, the projecting portion of the inner cap being closed at its rear end and extending axially, an outer diameter of which cylindrical projecting portion of the inner cap is smaller than an inner diameter of any of the sleeve-like body portion of the inner cap and a rear opening of the cap main body, the rear opening being defined by an inner edge of the inner flange of the cap main body; and at least one ventilating hole provided in the sleeve-like body portion of the inner cap at a position between the outer flange of the inner cap and said ribs, whereby the cap having been detached from the writing instrument permits open air to axially flow through the interior space of the cap through: a front axial opening of the cap main body; the ventilating hole of the inner cap; an intermediate space defined between an inner wall surface of the cap main body and an outer wall surface of the inner cap; and a clearance defined between the inner flange of the cap main body and an outer peripheral surface of the cylindrical projecting portion of the inner cap.

DESCRIPTION OF THE PREFERRED EMBODIMENTS

Figure 1:
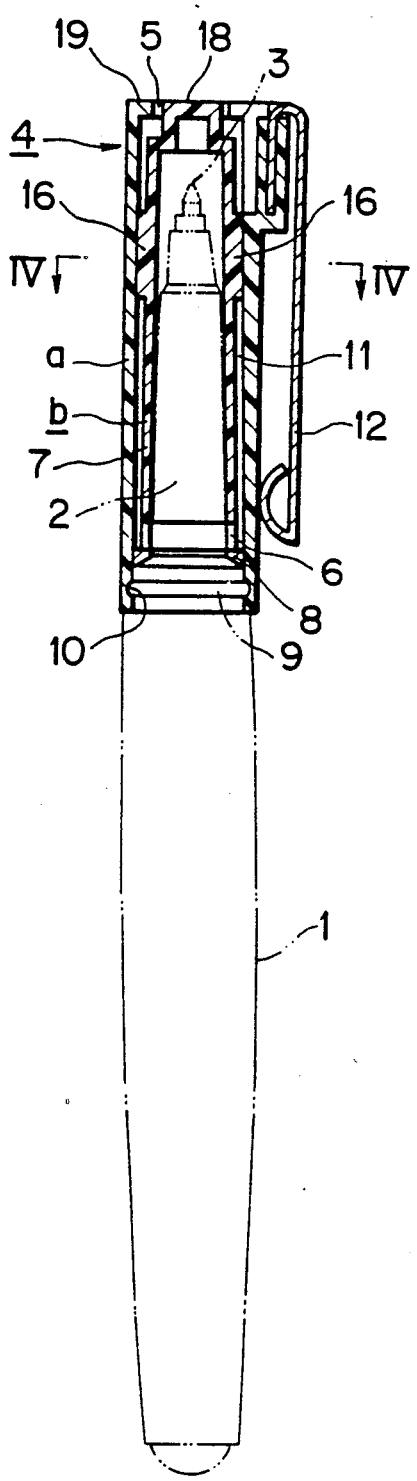
FIG. 1 is a partially longitudinal sectional view of an embodiment of a removable cap of the present invention attached to a writing instrument in an insertion manner.
Figure 2:
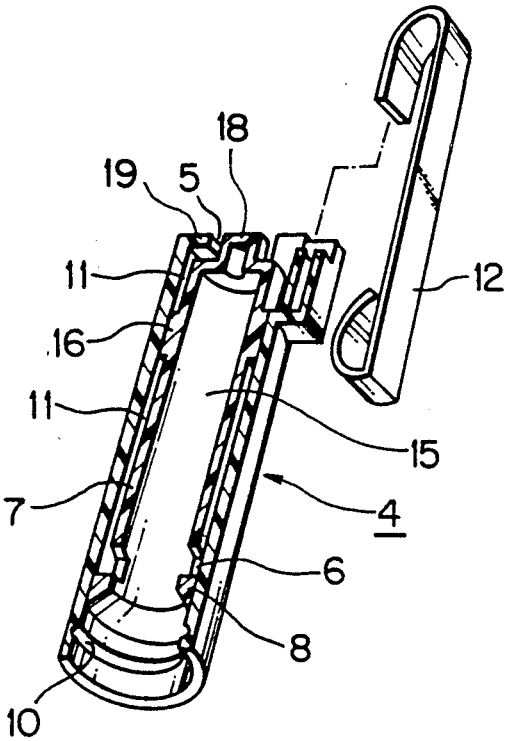
FIG. 2 is a perspective longitudinal sectional view of the cap of the present invention shown in FIG. 1.
Figure 3:
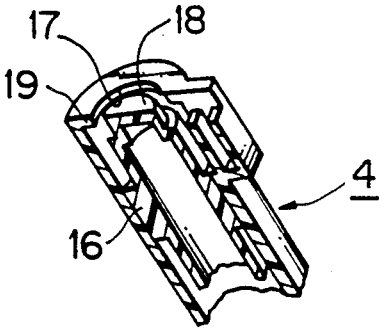
FIG. 3 is another perspective longitudinal sectional view of the cap of the present invention shown in FIG. 1, illustrating the rear end of the cap of the present invention.
Figure 5:
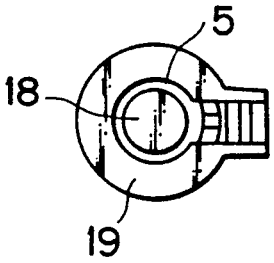
FIG. 5 is a rear view of the cap of the present invention.
Figure 4:
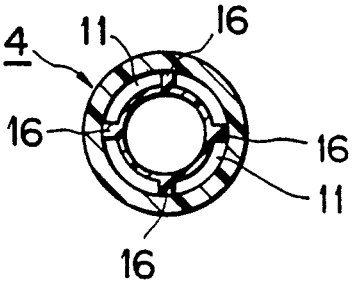
FIG. 4 is cross-sectional view of the cap of the present invention, taken along the line A—A of FIG. 1.
Figure 6:
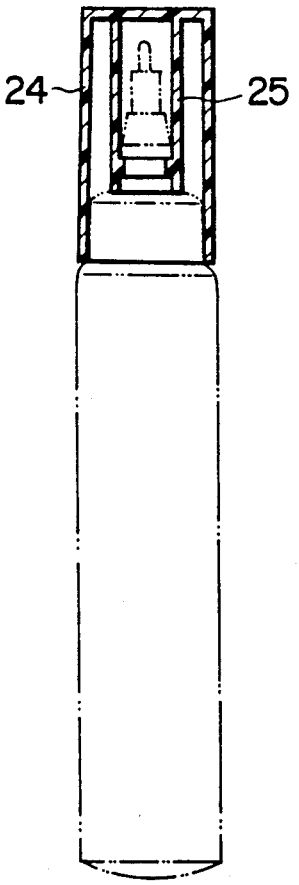
FIG. 6 PRIOR ART
FIG. 6 is a partially longitudinal sectional view of a conventional cap.
Figure 7:
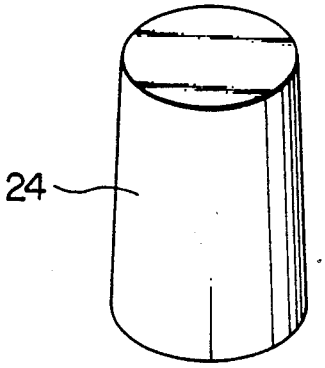
FIG. 7 PRIOR ART
FIG. 7 is a perspective view of the conventional cap shown in FIG. 6.
Figure 8:
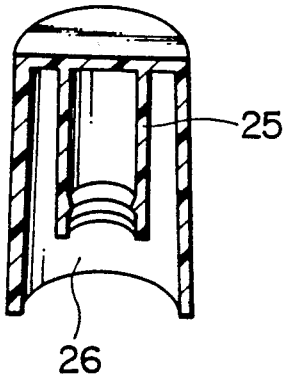
FIG. 8 PRIOR ART
FIG. 8 is a perspective longitudinal sectional view of the conventional cap shown in FIG. 6.
Figure 9:
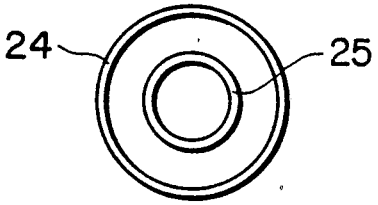
FIG. 9 PRIOR ART
FIG. 9 is a bottom view of the conventional cap shown in FIG. 6.

The present invention will be described hereinbelow, by way of example, in detail with reference to FIGS. 1 to 5 of the accompanying drawings. Since many changes and modifications can be made to the following construction without departing from the scope of the present invention, it is intended that all matters given in the following description and illustrated in FIGS. 1 to 5 of the accompanying drawings shall be interpreted to be illustrative only and not as a limitation to the scope of the present invention.

FIGS. 1 to 5 show an embodiment of a removable cap 4 of the present invention attached to a marking pen 1 in an insertion manner. The cap 4 assumes a hollow cylindrical shape and is detachably mounted on a front-end portion of the marking pen 1 to cover an ink-applying portion 3 of the marking pen 1.

The cap 4 is constructed of: a cap main body "a" made of a synthetic resin; and an inner cap "b" which is fixedly mounted in the cap main body "a" while made of a synthetic resin.

The cap main body "a" assumes a cylindrical shape having its front end opened, and has an inner flange 19 at its rear end in which a central opening 17 is provided. A pocket clip 12 constructed of a bent metal plate is fixedly mounted on an outer wall of a rear-end portion of the cap main body "a". In the embodiment of the present invention shown in FIG. 1, although the pocket clip 12 constitutes a separate member, it is possible that the pocket clip 12 is integrally formed with the cap main body "a".

The cap main body "a" is provided with a peripheral groove 10 in an inner wall of its front-end portion, which groove 10 detachably engages with a peripheral ridge 9 of the marking pen 1.

An outer diameter of the inner cap "b" is smaller than an inner diameter of the cap main body "a". The inner cap "b" is shorter in axial length than the cap main body "a", and has its front end opened and its rear end closed. The above closed rear end of the inner cap "b" is formed into a cylindrical projecting portion 18, an outer diameter of which projecting portion 18 is smaller than both of an outer diameter of an inner cap main body portion 7 and a diameter of the central opening 17 of the rear end of the cap main body "a".

An inner diameter of a front-end portion of the inner cap "b" permits a front-shaft portion 2 of the marking pen 1 to hermetically engage with the inner cap "b". The inner cap main body portion 7 of the inner cap "b" is provided with an outer flange 8 in its front end, which outer flange 8 radially extends outwardly from the front end of the inner cap main body portion 7 of the inner cap "b". In addition, the inner cap main body portion 7 of the inner cap "b" is provided with four ribs 16 in an outer peripheral surface of a substantially central portion of the inner cap main body portion 7 of the inner cap "b". These ribs 16 are spaced apart from each other in a circumferential direction of the inner cap main body portion 7 of the inner cap "b", and extend in an axial direction of the inner cap main body portion 7 of the inner cap "b". The number of the ribs 16 is not limited to four.

Both of the outer flange 8 and the ribs 16 of the inner cap "b"are press-fitted into the cap main body "a" so that the inner cap "b" if fixedly mounted in the cap main body "a". A pair of diametrically opposed ventilating holes 6 are formed in a peripheral wall of the inner cap "b" at positions behind the outer flange 8 of the inner cap "b". These ventilating holes 6 of the inner cap "b" are hermetically closed by means of a front-end portion of the marking pen 1 when the cap 4 is attached to the marking pen 1.

In assembling of the cap 4 of the present invention, the inner cap "b" is forcibly inserted into the cap main body "a" until the rear-end surface of the inner cap "b" is flush with a rear-end surface of the inner flange 19 of the cap main body "a". The thus forcibly inserted inner cap "b" is press-fitted to an inner wall of a predetermined position of the cap main body "a" by means of the ribs 16 and the outer flange 8 of the inner cap "b".

A suitable clearance 5 is provided between an outer peripheral surface of the cylindrical projecting portion 18 of the inner cap "b" and an inner peripheral surface of the rear end central opening 17 of the cap main body "a", and communicates with a space 11 defined between an inner peripheral wall of the cap main body "a" and an outer peripheral wall of the inner cap "b". In addition, the clearance 5 communicates with the interior space of the inner cap "b" through the ventilating holes 6 of the inner cap "b". Consequently, there is no fear that the cap 4 having been detached from the marking pen 1 suffocates infant's bronchi even if the infant swallows the cap 4 whole.

When the cap 4 of the present invention is mounted on the marking pen 1, both of the front-end opening of the inner cap "b" and the ventilation holes 6 of the inner cap "b" are hermetically closed by the marking pen 1 to permit the interior space of the inner cap "b" to be hermetically sealed, whereby the cap 4 of the present invention can prevents ink from evaporating and protects the ink-applying portion of the writing instrument from damage.

What is claimed is :

1. A removable cap attached to a writing instrument in an insertion manner for preventing ink from evaporating from said writing instrument and for protecting an ink-applying portion of said writing instrument from damage, comprising:

a hollow cylindrical cap main body having its opposite axial ends opened, said cap main body being provided with a hollow portion in its intermediate portion and an inner flange at a rear axial end, said inner flange extending radially inwardly at said rear axial end of said cap main body; and an hollow cylindrical inner cap fixedly mounted in said cap main body, said inner cap being closed at its rear end while provided with: a sleeve-like body portion an outer diameter of which is smaller than an inner diameter of said hollow portion of said cap main body and shorter in axial length than said cap main body; an outer flange portion radially extending outwardly from a front end of said sleeve-like body portion of said inner cap to serve as a means for fixing said inner cap to an inner wall of said cap main body; a plurality of ribs provided in an outer peripheral surface of an intermediate portion of said sleeve-like body portion of said inner cap, said ribs extending in an axial direction of said inner cap and being spaced apart from each other in a circumferential direction of said inner cap; a cylindrical projecting portion provided at a rear end of said inner cap, said projecting portion of said inner cap being closed at its rear end and extending axially, an outer diameter of which cylindrical projecting portion of said inner cap is smaller than an inner diameter of any of said sleeve-like body portion of said inner cap and a rear opening of said cap main body, said rear opening being defined by an inner edge of said inner flange of said cap main body; and at least one ventilating hole provided in said sleeve-like body portion of said inner cap at a position between said outer flange of said inner cap, and said ribs whereby said cap having been detached from said writing instrument permits open air to axially flow through the interior space of said cap through: a rear axial opening of said cap main body; said ventilating hole of said inner cap; an intermediate space defined between an inner wall surface of said cap main body and an outer wall surface of said inner cap; and a clearance defined between said inner flange of said cap main body and an outer peripheral surface of said cylindrical projecting portion of said inner cap.

* * * * *

UNITED STATES PATENT AND TRADEMARK OFFICE

CERTIFICATE OF CORRECTION

PATENT NO. : 5,000,603

DATED : March 19, 1991

INVENTOR(S) : Takashi ISOD

It is certified that error appears in the above-identified patent and that said Letters Patent is hereby corrected as shown below:

On the cover page, after Item [22], the following should appear:

-- [30] Foreign Application Priority Data

May 15, 1989 [JP] Japan . . . . . 1-69102 --.

Signed and Sealed this

Twenty-fourth Day of November, 1992

*Attest:*

DOUGLAS B. COMER

*Attesting Officer*

*Acting Commissioner of Patents and Trademarks*